US011177055B2

(12) United States Patent
Burkes

(10) Patent No.: US 11,177,055 B2
(45) Date of Patent: Nov. 16, 2021

(54) LEADING/LAGGING CABLE REFERENCING PLATFORM FOR MONITORING THE HEALTH OF UNDERGROUND CABLE NETWORKS

(71) Applicant: Savannah River Nuclear Solutions, LLC, Aiken, SC (US)

(72) Inventor: Klaehn W. Burkes, Wagener, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 809 days.

(21) Appl. No.: 15/910,407

(22) Filed: Mar. 2, 2018

(65) Prior Publication Data

US 2018/0254124 A1 Sep. 6, 2018

Related U.S. Application Data

(60) Provisional application No. 62/467,278, filed on Mar. 6, 2017.

(51) Int. Cl.
*H01B 7/28* (2006.01)
*H01B 7/32* (2006.01)

(52) U.S. Cl.
CPC ..... *H01B 7/2813* (2013.01); *H01B 7/32* (2013.01)

(58) Field of Classification Search
CPC ..... H01B 7/2813; H01B 7/32
See application file for complete search history.

(56) References Cited

U.S. PATENT DOCUMENTS

| | | | |
|---|---|---|---|
| 4,165,482 | A | 8/1979 | Gale |
| 4,887,041 | A | 12/1989 | Mashikian |
| 4,896,117 | A | 1/1990 | Floweredew |
| 5,272,439 | A | 12/1993 | Mashikian |

(Continued)

FOREIGN PATENT DOCUMENTS

| | | | |
|---|---|---|---|
| EP | 2437075 | B1 | 4/2012 |
| WO | WO 2015/197190 | A1 | 12/2015 |

OTHER PUBLICATIONS

Underground Distribution Cable Incipient Fault, Diagnosis System, A Dissertation by Mir Rasoul Jaafari Mousavi, Dec. 2005.

(Continued)

*Primary Examiner* — Huy Q Phan
*Assistant Examiner* — Adam S Clarke
(74) *Attorney, Agent, or Firm* — Dority & Manning, P.A.

(57) ABSTRACT

A system for detecting water trees in branching underground electrical cables includes a pulse generator configured to inject a pulse into a first underground cable that branches into a second underground cable and a third underground cable. The system includes a first sensor associated with the first cable, a second sensor associated with the second cable, and a third sensor associated with the third cable. The system includes a control device configured to obtain a first, second, and third signal associated with the first, second and third sensors, respectively. The control device determines a lead-lag relationship between the second and third signals and determines presence of a water tree within at least one of the second and third cable based on the lead-lag relationship. When presence of a water tree is determined, the control device generates a control action associated with repairing or replacing the second and/or third cable.

14 Claims, 13 Drawing Sheets

(56) References Cited

U.S. PATENT DOCUMENTS

| | | | | |
|---|---|---|---|---|
| 5,323,117 | A | 6/1994 | Endoh | |
| 5,530,364 | A | 6/1996 | Mashikian | |
| 5,570,028 | A | 10/1996 | Sperlazzo | |
| 5,600,248 | A | 2/1997 | Westrom | |
| 5,608,328 | A | 3/1997 | Sanderson | |
| 5,894,223 | A | 4/1999 | Medelius | |
| 5,977,773 | A | 11/1999 | Medelius | |
| 6,161,077 | A | 12/2000 | Fawcett | |
| 6,452,482 | B1 | 9/2002 | Cern | |
| 6,798,211 | B1 | 9/2004 | Rockwell | |
| 7,030,621 | B2 | 4/2006 | Sarkozi | |
| 7,196,529 | B2 | 3/2007 | Burnett | |
| 7,705,607 | B2 | 4/2010 | Mashikian | |
| 8,847,606 | B2 | 9/2014 | While | |
| 9,453,871 | B2 | 9/2016 | Reynaud | |
| 2009/0256576 | A1* | 10/2009 | Weems, II | G01R 31/08 324/520 |
| 2013/0124119 | A1* | 5/2013 | Reynaud | G01R 31/11 702/59 |
| 2017/0199235 | A1* | 7/2017 | Jeon | G01R 31/58 |

OTHER PUBLICATIONS

IIEE Power and Energy Technology Systems Journal, Waier Tree Detection in Underground Cables Using Time Domain Reflectometry, Klaehn W. Burkes, Elham B Makram, Ramtin Hadidi, Feb. 13, 2015.

Burkes, et al. "Modeling the Effect of a Water Tree inside Tape Shield and Concentric Neutral Cables" *Proc. COMSOL Conf.* (2014) pp. 1-9.

Densley, J. "Ageing mechanisms and diagnostics for power cables—an overview" *IEEE Elect. Insul. Mag.* 17 (2001) pp. 14-22.

Dubickas, V. "On-Line time domain reflectometry diagnostic of medium voltage XPE power cables" *KTH* (2006) pp. 1-83.

Thue, W.A. "Ch. 19: Treeing" *Electric Power Cable Engineering* CRC Press (2012) pp. 367-384.

* cited by examiner

LEADING/LAGGING CABLE REFERENCING PLATFORM FOR MONITORING THE HEALTH OF UNDERGROUND CABLE NETWORKS

PRIORITY STATEMENT

The present application claims the benefit of priority of U.S. Provisional Patent Application No. 62/467,278, entitled "LEADING/LAGGING CABLE REFERENCING PLATFORM FOR MONITORING THE HEALTH OF UNDERGROUND CABLE NETWORKS," filed Mar. 6, 2017, which is incorporated herein by reference.

FEDERAL RESEARCH STATEMENT

This invention was made with Government support under Contract No. DE-AC09-085R22470, awarded by the U.S. Department of Energy. The Government has certain rights in the invention.

FIELD

The present disclosure relates generally to a system and method for detecting degradation in branching underground electrical cables.

BACKGROUND

The increasing practice of underground residential distributed (URD) cables being installed in power systems requires utility companies to know the health of these cables. Since the health of URD cables cannot be determined by visual methods like overhead lines, a better understanding of the power cable and its aging process is needed. Insulation of medium voltage URD power cables age due to a phenomenon called water treeing. Water trees are important to utility companies, because water trees cannot be detected using traditional protection methods. Also, water trees are the main reason for URD cable failures, yet water trees can grow in cables without any effect on the voltage or currents. For example, water trees can grow across the insulation and still not cause the cable to fault. Also, water trees do not produce partial discharges, which are a common cable diagnostic tool. Accordingly, detecting water trees becomes very difficult and expensive.

SUMMARY

Aspects and advantages of the present disclosure will be set forth in part in the following description, or may be apparent from the description, or may be learned through practice of the present disclosure.

In one aspect, the present disclosure relates to a system for detecting water trees in branching underground electrical cables. The system includes a pulse generator configured to inject a pulse into a first underground cable that branches into a second underground cable and a third underground cable. The system includes a first sensor, a second sensor, and a third sensor. The first sensor is associated with the first underground cable. The second sensor is associated with the second underground cable. The third sensor is associated with the third underground cable. The system includes a control device configured to perform operations. The operations include obtaining a first, second, and third signal associated with the first, second and third sensors, respectively. The operations include determining a lead-lag relationship between the second signal and the third signal. The operations include determining presence of a water tree within at least one of the second underground cable and the third underground cable based on the lead-lag relationship. When the control device determines presence of a water tree, the control device generates one or more control actions associated with repairing or replacing at least one of the second underground cable and the third underground cable.

In another aspect, the present disclosure relates to a method for detecting water trees in branching underground electrical cables comprising a first underground cable that branches into a second underground cable and a third underground cable. The method includes injecting, by a pulse generator, a pulse into the first underground cable. The method includes obtaining, by one or more control devices, a first signal associated with a first sensor configured to detect signals traveling along the first underground cable. The method includes obtaining, by the control device(s), a second signal associated with a second sensor configured to detect signals traveling along the second underground cable. The method includes obtaining, by the control device(s), a third signal associated with a third sensor configured to detect signals traveling along the third underground cable. The method includes determining, by the control device(s), a lead-lag relationship between the second signal and the third signal. The method includes determining, by the control device(s), presence of a water tree within at least one of the second underground cable and the third underground cable based on the lead-lag relationship. When presence of a water tree is detected, the method includes generating, by the control device(s), one or more control actions associated with repairing or replacing at least one of the second underground cable and the third underground cable.

In yet another aspect, the present disclosure relates to a sensor for a system for detecting water trees in branching underground electrical cables. The sensor includes a circuit board comprising a first side and a second side. The sensor includes a filter circuit disposed on the circuit board. The filter circuit can be configured to filter alternating current associated with an underground cable of the branching underground cables. The sensor includes a spring coupled to the first side of the circuit board. The spring can be configured to electrically couple the circuit board to the underground cable. The sensor includes one or more circuit components coupled to the second side of the circuit board.

These and other features, aspects and advantages of the present disclosure will become better understood with reference to the following description and appended claims. The accompanying drawings, which are incorporated in and constitute a part of this specification, illustrate embodiments of the invention and, together with the description, serve to explain the principles of the present disclosure.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
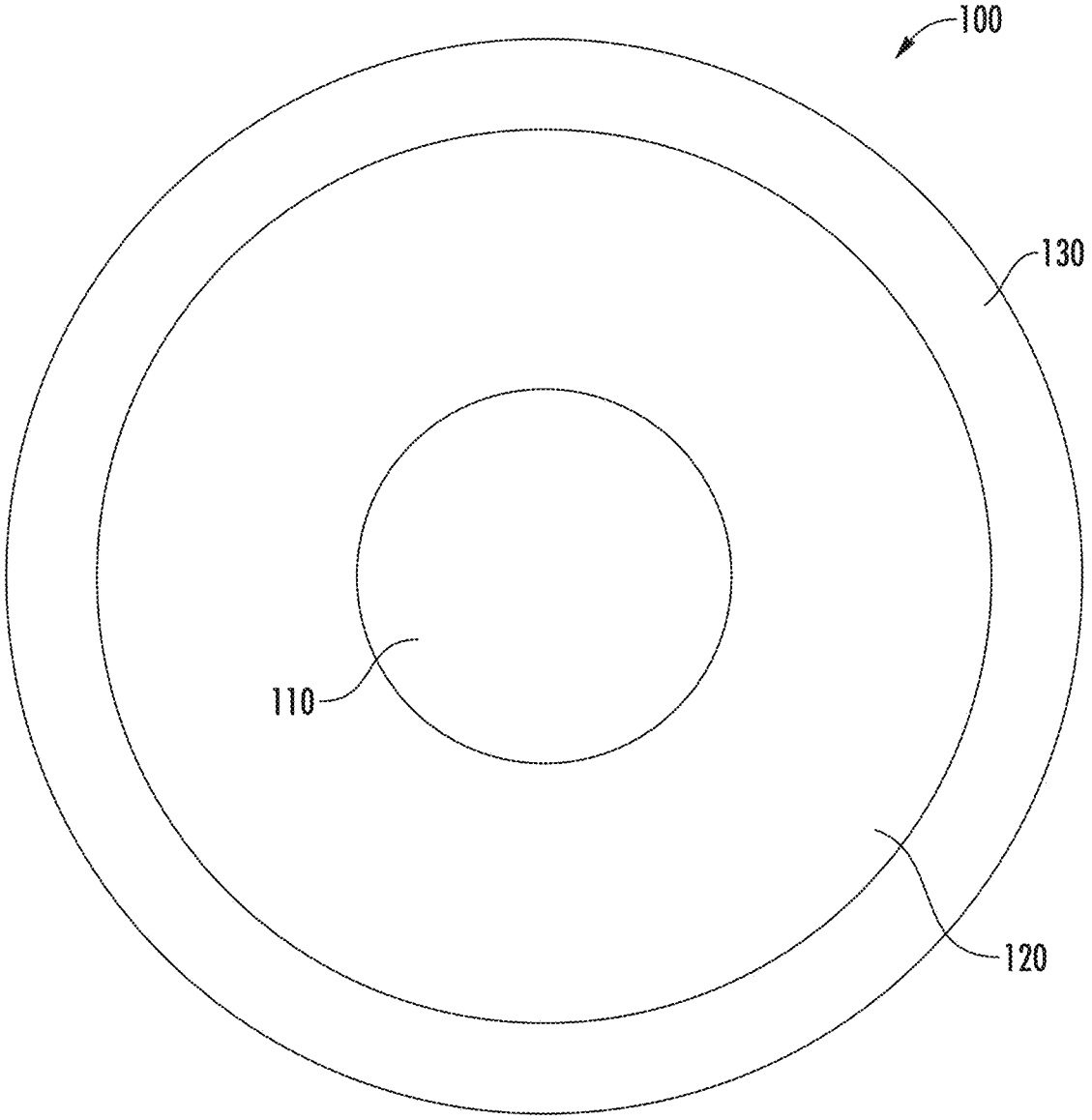
FIG. 1 provides a cross-sectional view of a cable according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present disclosure without departing from the scope or spirit of the disclosure. For instance, features illustrated or described as part of one embodiment can be used with another embodiment to yield a still further embodiment. Thus, it is intended that the present disclosure covers such modifications and variations as come within the scope of the appended claims and their equivalents.

Time Domain Reflectometry (TDR) is a traveling wave based method that can be used to determine whether water trees are present within an underground cable. TDR can be performed off-line or on-line. When a traveling wave is sent down an underground cable, a reflection of the wave will be generated when the wave reaches the end of the underground cable or an element (e.g., water tree) having a different impedance compared to the impedance of the cable. This reflection can be used to locate water trees in an underground cable, because the section of the underground cable with the water tree will change the impedance in that section. An early reflection is indicative of water trees in the underground cable.

Traveling wave theory indicates that an injected electrical pulse will travel through a medium at a specific speed until the pulse reaches a mismatch in properties at which a reflection will occur. Conventional systems inject a pulse into a network and record a reference response. Any deviation from the reference response indicates a change in network health. However, due to the topology of the network, determining the location of the change in network health is very difficult.

In one example embodiment, the present disclosure uses signals from branching underground cables as reference signals relative to each other to isolate changes in insulation health. Utilizing a leading or lagging reflection pulse, the change in insulation health can be pinpointed to a specific underground cable. The leading or lagging reflection is utilized because of the configuration with which the cables are connected to a bus. When a reflection pulse returns to the beginning of a cable, it is transmitted into all of the cables connected at that bus. A time delay occurs between when the reflection is measured in the corresponding cable and in other cables connected at the bus. Therefore, when looking at all the measured signals at a single bus, the cable's signal with a measurement reflection which leads the others indicates the underground cable which created the reflection. The signals which are lagging are understood to not be related to the underground cable of interest.

Referring now to the FIGS., FIG. 1 depicts a cross-sectional view of a underground cable 100 according to example embodiments of the present disclosure. As shown, the underground cable 100 includes a conductor 110 surrounded by insulation 120. In example embodiments, the underground cable 100 can include a ground sheath 130 that surrounds the insulation 120.

The conductor 110 can be comprised of any suitable conductive material. For instance, the conductor 110 can be comprised of copper. The insulation 120 can be comprised of any suitable insulating material. For instance, the insulation 120 can be comprised of cross-linked polyethylene insulation (XLPE). The ground sheath 130 can be comprised of any suitable conductive material. For instance, the ground sheath 130 can be comprised of copper.

Figure 2:
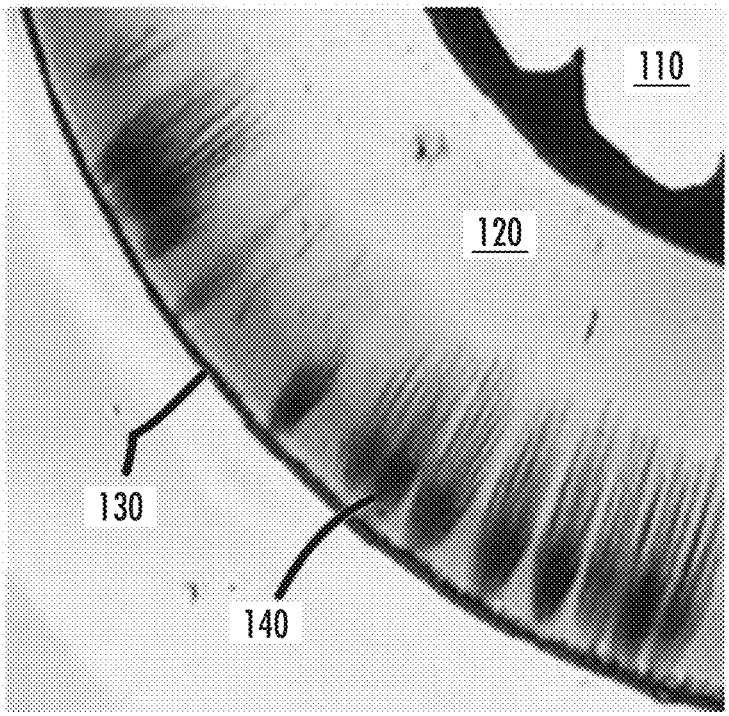
FIG. 2 provides another cross-sectional view of a cable according to example embodiments of the present disclosure.

FIG. 2 depicts another cross-sectional view of the underground cable 100. As shown, the underground cable 100 includes water trees 140 growing from the ground sheath 130 towards the conductor 110. More specifically, the water trees 140 can grow across the insulation 120. The water trees 140 generally develop due to discontinuities in the insulation 120 or cracks in the ground sheath 130. For instance, discontinuities in the insulation 120 can cause the electric field to increase. As the electric field increases, micro-fractures can develop in the insulation. Over time, the micro-fractures can fill with moisture and further increase the electric field. The water trees 140 will continue to grow inward towards the conductor 110. Once the water trees 140 reach the conductor 110, the cable 100 will no longer conduct electricity and will need to be replaced. Since replacing underground cables (e.g., underground cable 100) is expensive and time-consuming, systems and methods for detecting water trees have been developed to monitor the health of underground cables.

Figure 3:
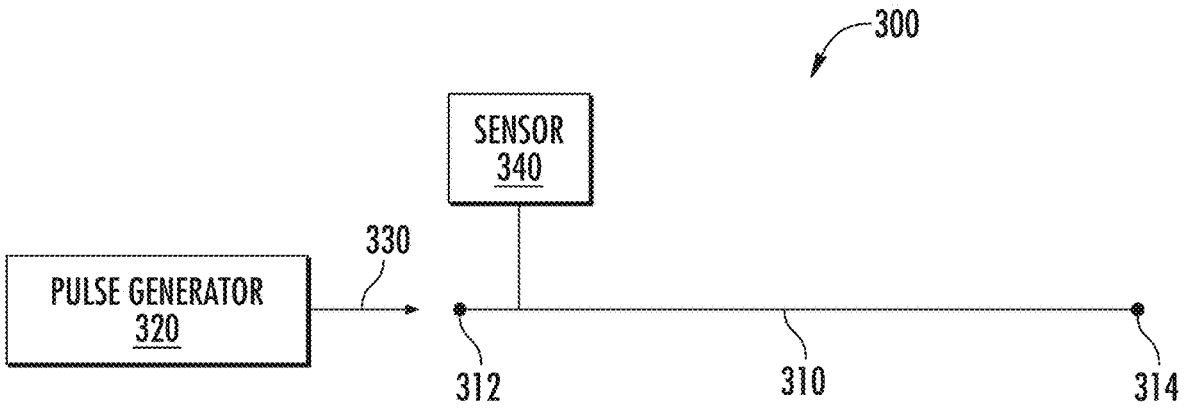
FIG. 3 provides a block diagram of a system for detecting water trees in an underground cable according to example embodiments of the present disclosure.

FIG. 3 depicts a system 300 for detecting water trees in an underground electrical cable 310 having a first end 312 and a second end 314. As shown, the system 300 includes a pulse generator 320 configured to inject a pulse 330 (e.g., electrical signal) into the underground electrical cable 310. More specifically, the pulse generator 320 injects the pulse 330 via the first end 312 of the underground electrical cable 310. The system 300 can include a sensor 340 associated with the underground electrical cable 310. The sensor 340 can be configured to detect the pulse P traveling along the underground electrical cable 310. As will be discussed below in more detail, the sensor 340 can detect reflection pulses that can indicate presence of one or more water trees within the underground electrical cable 310.

Figure 4:
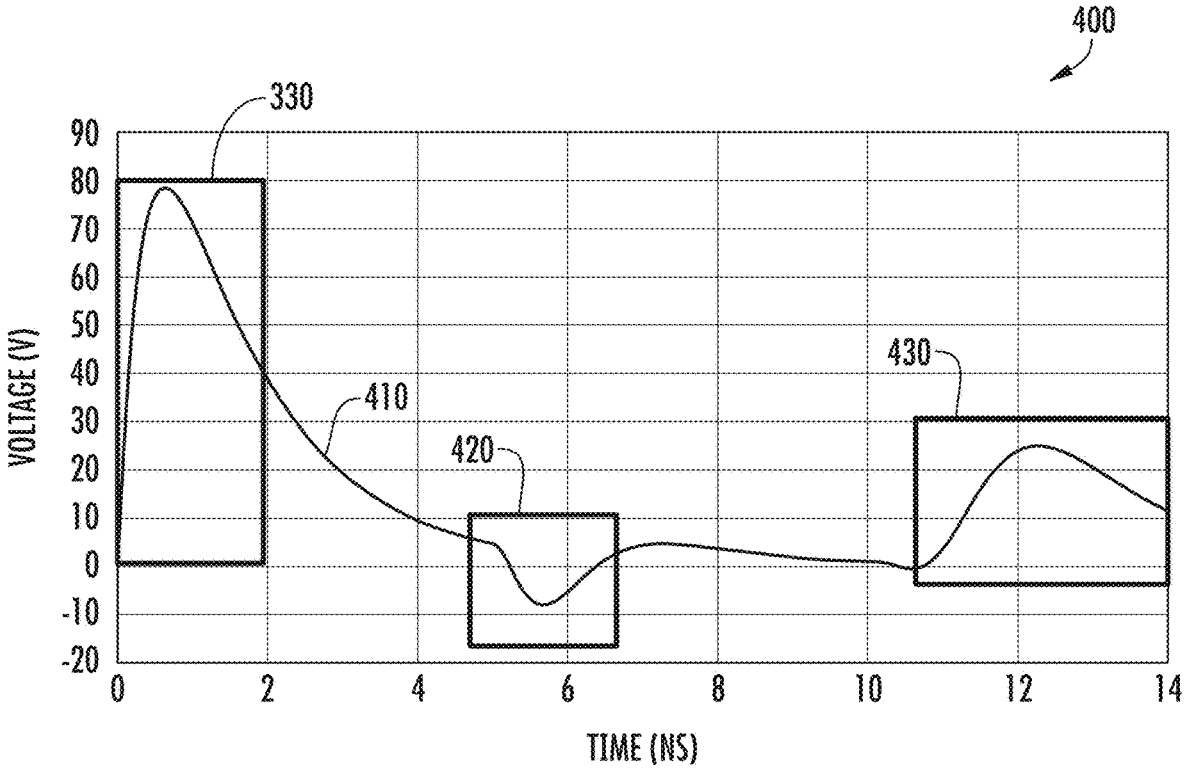
FIG. 4 provides a graph depicting presence of a water tree in an underground cable according to example embodiments of the present disclosure.

FIG. 4 depicts a graph 400 of a signal 410 measured by the sensor 340 of FIG. 3. The abscissa of the graph 400 corresponds to voltage (V), and the ordinate of the graph 400 corresponds to time (T). As shown, the signal 410 includes the pulse 330 that is injected into the underground electrical cable 310. The signal 410 also includes a first reflection pulse 420 and a second reflection pulse 430. The first reflection pulse 420 occurs between the pulse 330 and the second reflection pulse 430. The second reflection pulse 430 can indicate the pulse P reflecting off the second end 314 (FIG. 3) of the underground electrical cable 310. The first reflection pulse 420 can indicate the presence of a water tree between the first and second ends (312, 314) of the underground electrical cable 310. As shown, the first reflection pulse 420 is inverted relative to the pulse P and the second reflection pulse 430, because the impedance of the water tree is different than the impedance of the underground electrical cable 310. In example embodiments, a location of the water tree within the underground electrical cable 310 can be determined based, at least in part, on a time delay between the first reflection pulse 420 and the second reflection pulse 430.

Figure 5:
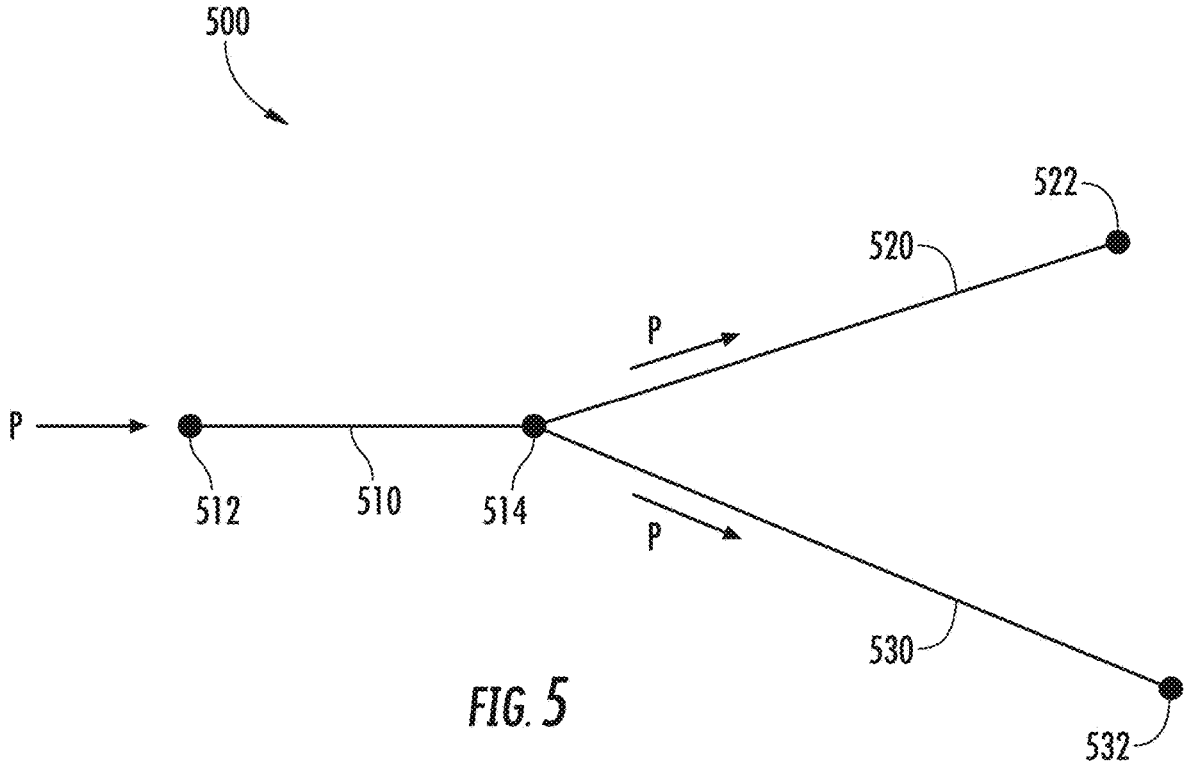
FIG. 5 provides a schematic of branching underground electrical cables according to example embodiments of the present disclosure.

Referring now to FIG. 5, a schematic of branching underground electrical cables 500 are provided according to example embodiments of the present disclosure. As shown, the branching underground electrical cables 500 can include a first underground cable 510 branching into a second underground cable 520 and a third underground cable 530. The first underground cable 510 can include a first end 512 and a second end 514. In example embodiments, the first underground cable 510 can branch into the second and third underground cables 520, 530 at the second end 514 of the first underground cable 510. As shown, the second underground cable 520 can extend to an endpoint 522. Likewise, the third underground cable can extend to an endpoint 532.

In example embodiments, a pulse P injected into the first end 512 of the first underground cable 510 can travel along the first underground cable 510 and into both the second and third underground cables 520, 530. A reflected pulse in second underground cable 520 can then travel into the first and third underground cables 510, 530. Likewise, a reflected pulse in the third underground cable 530 can travel into the first and second underground cables 510, 520.

Figure 6:
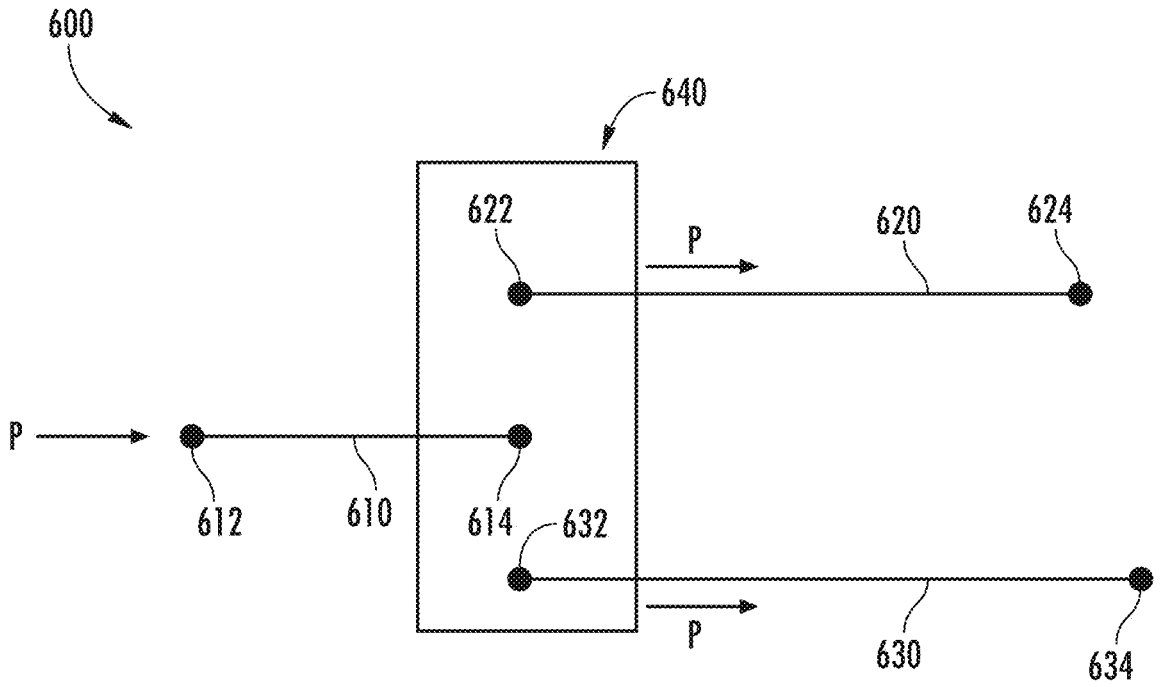
FIG. 6 provides another schematic of branching underground electrical cables according to example embodiments of the present disclosure.

Referring briefly now to FIG. 6, another schematic of branching underground electrical cables 600 is provided according to example embodiments of the present disclosure 600. As shown, the branching underground electrical cables 600 can include a first underground cable 610, a second underground cable 620, and a third underground cable 630. The first, second, and third underground cables 610, 620, 630 can each include a first end 612, 622, 632 and a second end 614, 624, 634.

In example embodiments, the first, second and third underground cables 610, 620, 630 can each be coupled to a busbar 640. For instance, the second end 614 of the first underground cable 610 can be coupled to the busbar 640, and the first end 622, 632 of both the second and third underground cables 620, 630 can be coupled to the busbar 640. In this manner, a pulse P injected into the first end 612 of the first underground cable 610 can travel along the first underground cable 610 and into both the second and third underground cables 620, 630. A reflected pulse in the second underground cable 620 can travel into the first and third underground cables 610, 610. Likewise, a reflected pulse in the third underground cable 630 can travel into the first and second underground cables 610, 620. As will be discussed below in more detail, the present disclosure provides a system and method for detecting water trees in branching underground cables, such as those depicted in FIGS. 5 and 6.

Figure 7:
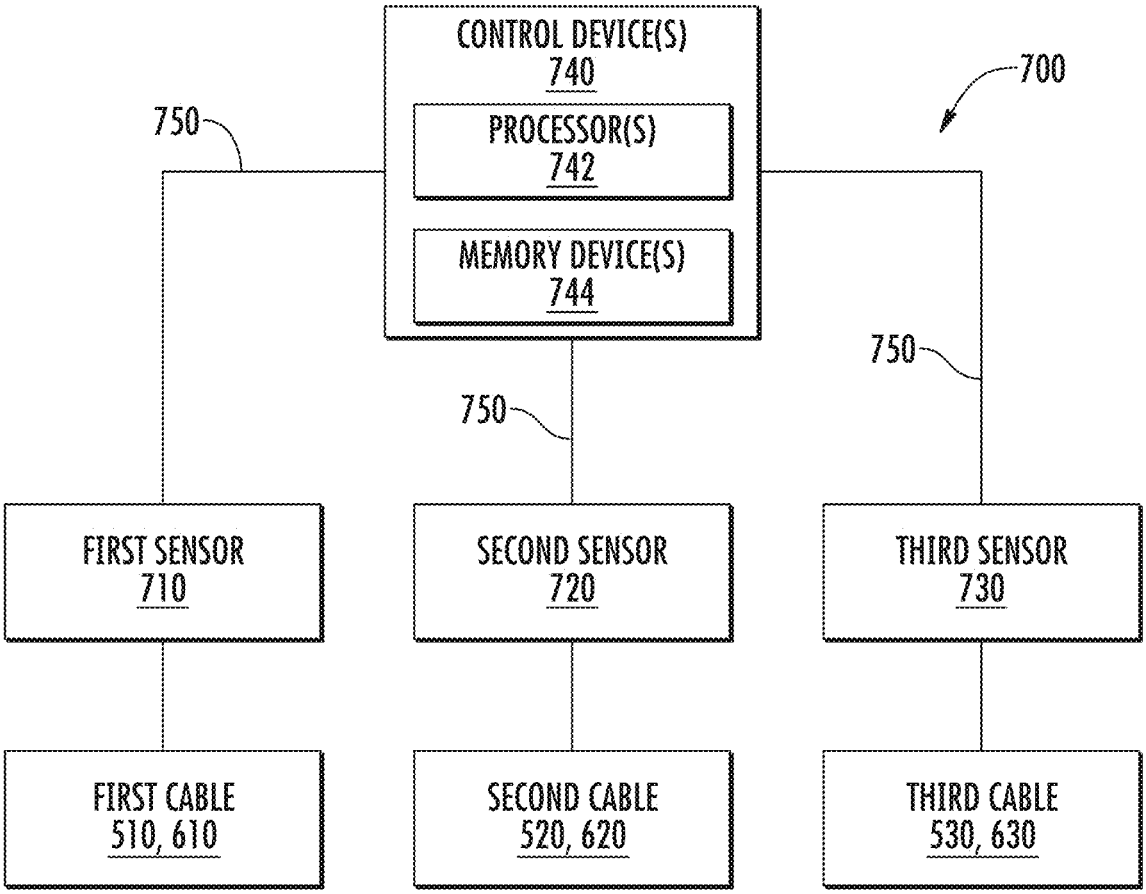
FIG. 7 provides a system for detecting water trees in branching underground electrical cables according to example embodiments of the present disclosure.

FIG. 7 depicts a block diagram of a system 700 for detecting water trees in branching underground electrical cables according to example embodiments of the present disclosure. As shown, the system 700 includes a first sensor 710, a second sensor 720, and a third sensor 730. The first sensor 710 can be associated with the first underground cable 510, 610 and configured to detect signals traveling along the first underground cables 510, 610. In example embodiments, the first sensor 710 can be positioned at the second end 614 of the first underground cable 610. Alternatively, the first sensor 710 can be positioned at the first end 612 of the first underground cable 610. The second sensor 720 can be associated with the second underground cable 520, 620 and configured to detect signals traveling along the second underground cable 520, 620. In example embodiments, the second sensor 720 can be positioned at the first end 622 of the second underground cable 620. The third sensor 730 can be associated with the third underground cable 530, 630 and configured to detect signals traveling along the third underground cable 530, 630. In example embodiments, the third sensor 730 can be positioned at the first end 632 of the third underground cable 630.

The system 700 can include one or more control devices 740. In general, the control device(s) 740 can correspond to any suitable processor-based device, including one or more computing devices. For example, the control device(s) 740 may include one or more processors 742 and one or more associated memory devices 744 configured to perform a variety of computer-implemented functions (e.g., performing the methods, steps, calculations, and the like disclosed herein). As used herein, the term "processor" refers not only to integrated circuits referred to in the art as being included in a computer, but also refers to a controller, microcontroller, a microcomputer, a programmable logic controller (PLC), an application specific integrated circuit (ASIC), a Field Programmable Gate Array (FPGA), and other programmable circuits. Additionally, the memory device(s) 744 may generally include memory element(s) including, but not limited to, a computer readable medium (e.g., random access memory (RAM)), a computer readable non-volatile medium (e.g., flash memory), a compact disc-read only memory (CD-ROM), a magneto-optical disk (MOD), a digital versatile disc (DVD), and/or other suitable memory elements or combinations thereof. The memory device(s) 744 may store instructions that, when executed by the processor 742, cause the processor 742 to perform various operations.

The control device(s) 740 can be communicatively coupled to the sensors 710, 720, 730 via any suitable wired or wireless connection 750. In this manner, the control device(s) 740 can receive the signals detected by the sensors 710, 720, 730. As will be discussed below in more detail, the control device(s) 740 can process the signals to determine a location of a water tree in the branching underground cables 500, 600. More specifically, the control device(s) 740 can determine whether a water tree is present within the second underground cable 520, 620, the third underground cable 530, 630, or both.

Figure 8:
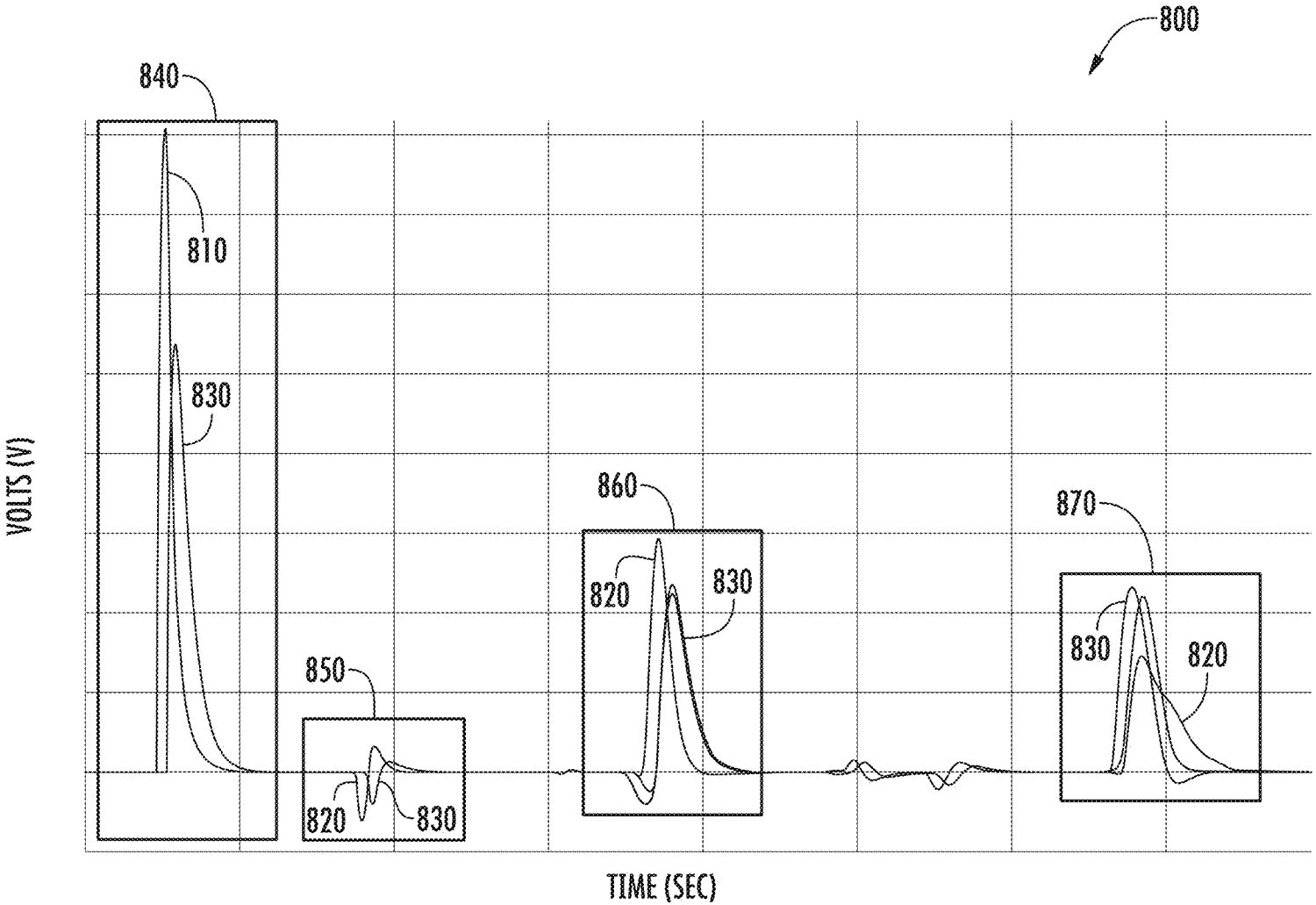
FIG. 8 provides a graph depicting measured signals in the first, second, and third underground cables of the system depicted in FIGS. 5 and 6.

FIG. 8 depicts a graph 800 of signals obtained from sensors 710, 720, 730 (FIG. 7) according to example embodiments of the present disclosure. The abscissa of the graph 800 corresponds to voltage (V), and the ordinate of the graph 800 corresponds to time (T). As shown, a first signal 810 is obtained from the first sensor 710, a second signal 820 is obtained from the second sensor 710, and a third signal 830 is obtained from the third sensor 730. The graph 800 illustrates pulses obtained during a first period of time 840. Additionally, the graph 800 illustrates reflected pulses that are obtained during a second period of time 850, a third period of time 860, and a fourth period of time 870. Each of the above periods of time 840, 850, 860, 870 will be discussed below in more detail.

During the first period of time 840, the pulse P (FIGS. 5 and 6) is injected into the first underground cable 510, 610 (FIGS. 5 and 6). In example embodiments, the pulse P can be measured at the second end 614 of the first underground cable 610 and the first end 622, 632 of the second and third underground cables 620 and 630, respectively. Since the pulse P travels along the first underground cable 510, 610 and subsequently enters the second underground cable 520, 620 (FIGS. 5 and 6) and the third underground cable 530, 630 (FIGS. 5 and 6), the first signal 810 leads both the second signal 820 and the third signal 830 during the first period of time 840. It should be appreciated that the pulse P can, in some embodiments, simultaneously enter the second underground cable 520, 620 and the third underground cable 530, 630. As such, the second and third signals 820, 830 may coincide with one another during the first period of time 840.

During the second period of time 850, the second signal 820 and the third signal 830 each comprise a first reflected pulse. As shown, the first reflected pulse of the second signal 820 leads the first reflected pulse of the third signal 830. Furthermore, since the second signal 820 leads the third signal 830 during the second period of time 850, the one or more control device(s) 740 can determine the first reflected pulse originated in the second underground cable 520, 620 and subsequently traveled into the third underground cable 530, 630. In example embodiments, the first reflected pulse can indicate the presence of a water tree within the second underground cable 520, 630. More specifically, the control device(s) 740 can determine the first reflected pulse is indicative of a water tree in the second underground cable 520, 620. In example embodiments, the water tree can be similar to the water tree 140 depicted in FIG. 2.

During the third period of time 860, the second signal 820 and the third signal 830 each comprise a second reflected pulse. As shown, the second reflected pulse of the second signal 820 leads the second reflected pulse of the third signal 830. Furthermore, since the second signal 820 continues to lead the third signal 830 during the third period of time 860, the one or more control device(s) 740 can determine the second reflected pulse originated in the second underground cable 520, 620 and subsequently traveled into the third underground cable 530, 630. In example embodiments, the second reflected pulse can indicate the pulse P reaching the second end 624 of the second underground cable 620, returning to the first end 622 of the second underground cable 620, and subsequently entering the third underground cable 630.

The control device(s) 740 can be configured to determine a location of the water tree within the second underground cable 520, 620. For instance, the control device(s) 740 can determine the location of the water tree based, at least in part, on a time delay between the first and second reflected pulses of the second signal 820. Furthermore, once the control device(s) 740 determine the location of the water tree, the control device(s) 740 can generate one or more control actions associated with repairing or replacing the second underground cable 520, 620. For instance, the control device(s) 740 can provide one or more notifications (e.g., email, text-message, etc.) to authorized personnel. In this manner, the notifications can apprise authorized personnel of the water trees and allow them to take appropriate action (e.g., repair or replace the underground cable with the water tree).

During the fourth period of time 870, the second signal 820 and the third signal 830 each comprise a third reflected pulse. As shown, the third reflected pulse of the third signal 830 leads the third reflected pulse of the second signal 820. Since the third signal 830 leads the second signal 820 during the fourth period of time 870, the one or more control device(s) 740 can determine the third reflected pulse originated in the third underground cable 530, 630. In example embodiments, the third reflected pulse can indicate the pulse P reaching the second end 634 of the third underground cable 630, returning to the first end 632 of the third underground cable 630, and subsequently entering the second underground cable 620.

Although the graph 800 depicted in FIG. 8 illustrates detecting a water tree in the second underground cable 520, 620, it will be appreciated that the present disclosure is not limited to detecting water trees in the second underground cable 520, 620. For instance, the system 700 of FIG. 7 can detect water trees in the third underground cable 530, 630 and first underground cable 510, 610 in the same manner. More specifically, the system 700 can detect water trees in more than one underground cable, such as the second underground cable 520, 620 and the third underground cable 530, 630.

Figure 9:
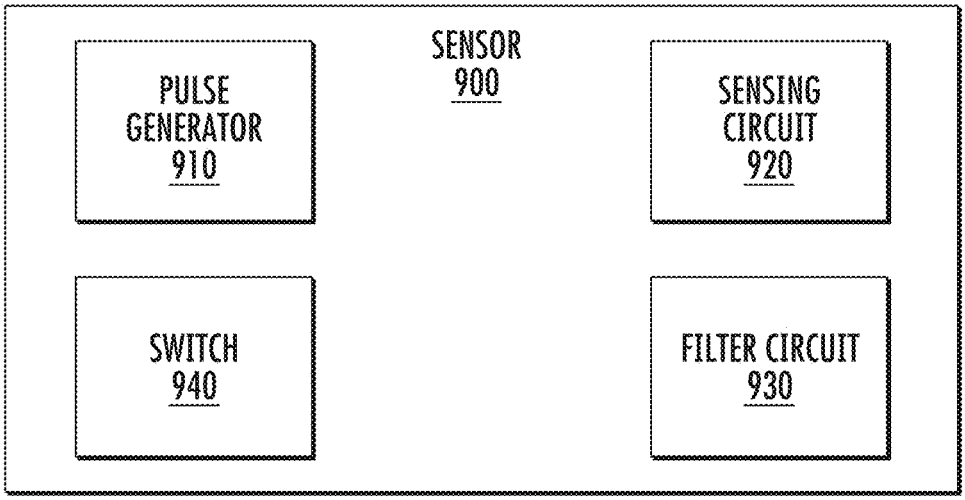
FIG. 9 provides a block diagram of an example sensor according to example embodiments of the present disclosure.

FIG. 9 depicts a block diagram of an example sensor 900 according to example embodiments of the present disclosure. It should be appreciated that the sensor 900 can be used in the system 700 of FIG. 7 as any one of the sensors 710, 720, 730. As shown, the sensor 900 can include a pulse generator 910. In example embodiments, the pulse generator 910 can be configured to inject the pulse into one of the underground cables depicted in FIGS. 5 and 6. The sensor 900 can include a sensing circuit 920 configured to detect signals traveling along one of the underground cables. More specifically, the signals can include pulses and reflected pulses traveling along one of the underground cables. It should be appreciated that the sensing circuit 920 can be comprised of any suitable electrical components, such as resistors, capacitors, inductors, etc.

The sensor 900 can include a filter circuit 930. The filter circuit 930 can filter alternating current power traveling along the underground cables. More specifically, the filter circuit 930 can filter the alternating current power from the signals traveling along the underground cables. In this manner, the sensing circuit can be isolated from the alternating current power.

In example embodiments, the sensor 900 can include a switch 940 movable between a first position and a second position. When the switch is in the first position, the sensor 900 can be configured to transmit the pulse via the pulse generator 910. When the switch 940 is in the second position, the switch can be configured to receive a pulse that has already been injected into one of the cables. In this manner, the sensor 900 can transmit pulses or receive reflected pulses.

Figure 10:
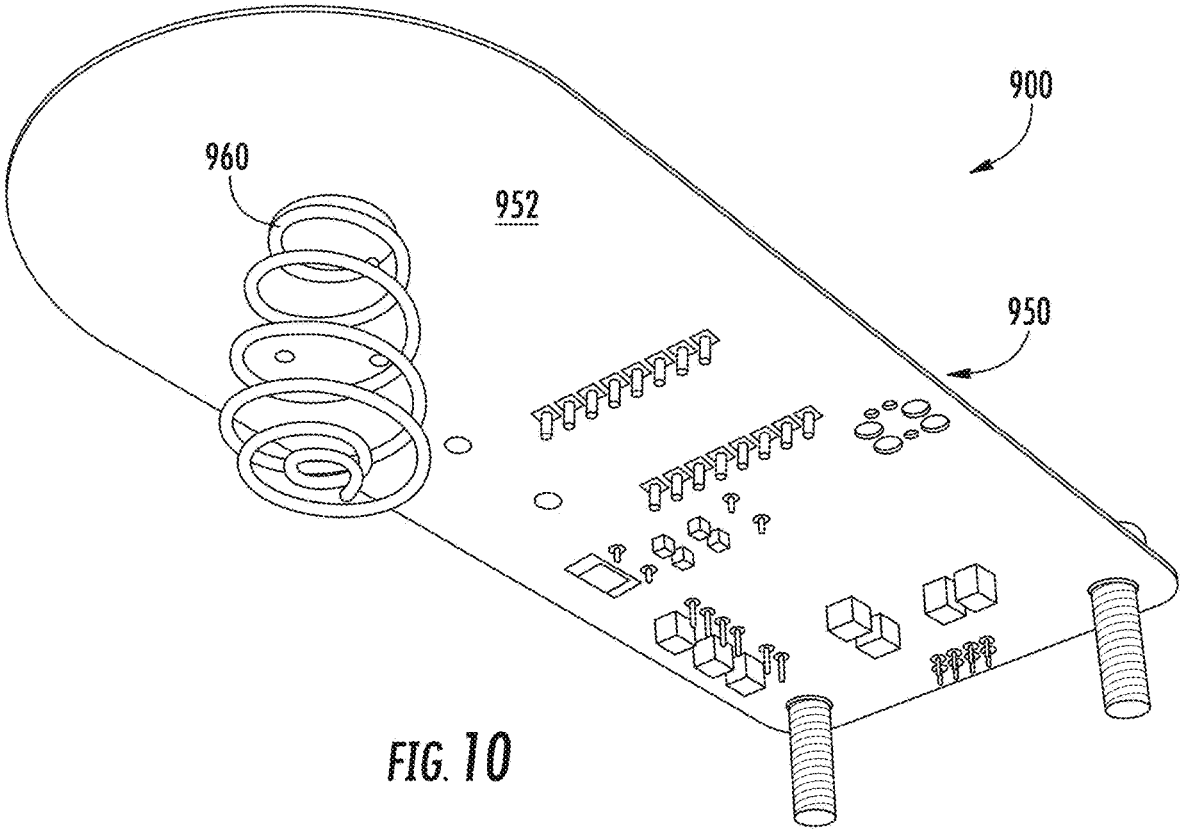
FIG. 10 provides a bottom perspective view of a sensor according to example embodiments of the present disclosure.
Figure 11:
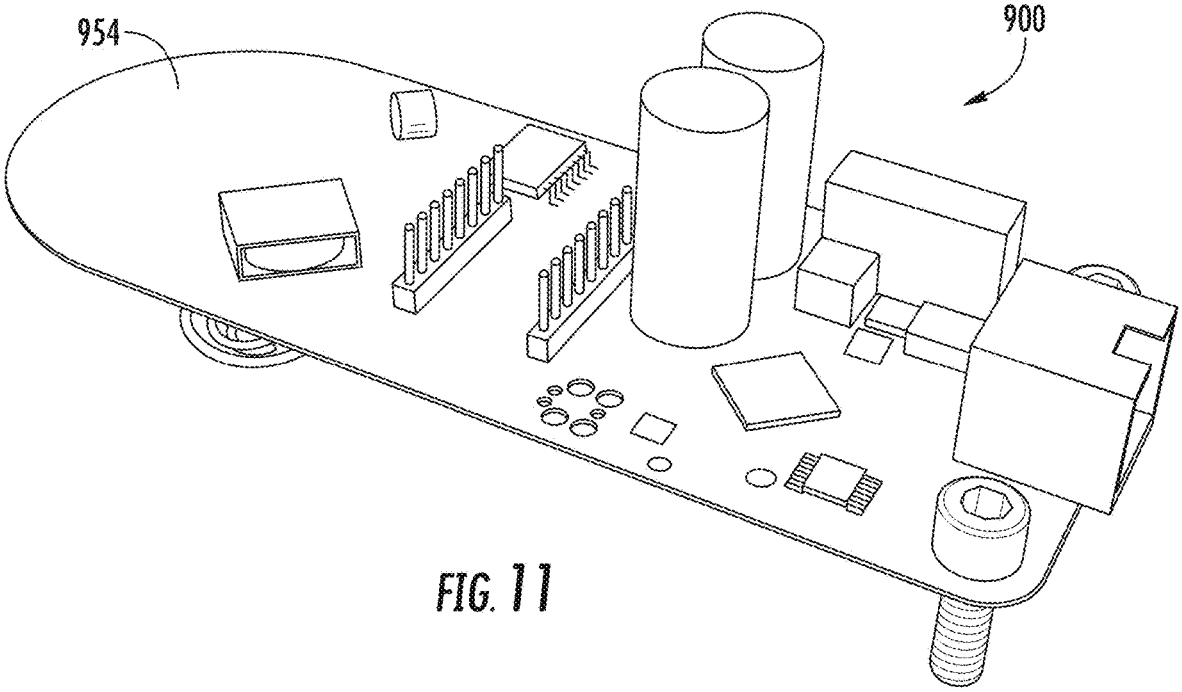
FIG. 11 provides a top perspective view of a sensor according to example embodiments of the present disclosure.

Referring now to FIGS. 10 and 11 in combination, an example embodiment of the sensor 900 is provided according to example embodiments of the present disclosure. As shown, the sensor 900 can comprise a circuit board 950 having a first side 952 and a second side 954. The sensor 900 can include a spring 960 coupled to the first side 952 of the circuit board 950. In example embodiments, the circuit board 950 can be coupled to one of the underground cables via the spring 960. More specifically, the spring 960 can contact a capacitive test point on a load-break connector 1000 (FIG. 12) coupled to one of the underground cables. In example embodiments, at least one of the pulse generator 910 (FIG. 9), the sensing circuit 920, and the switch 940 can be coupled to the second side 954 of the circuit board 950.

Figure 12:
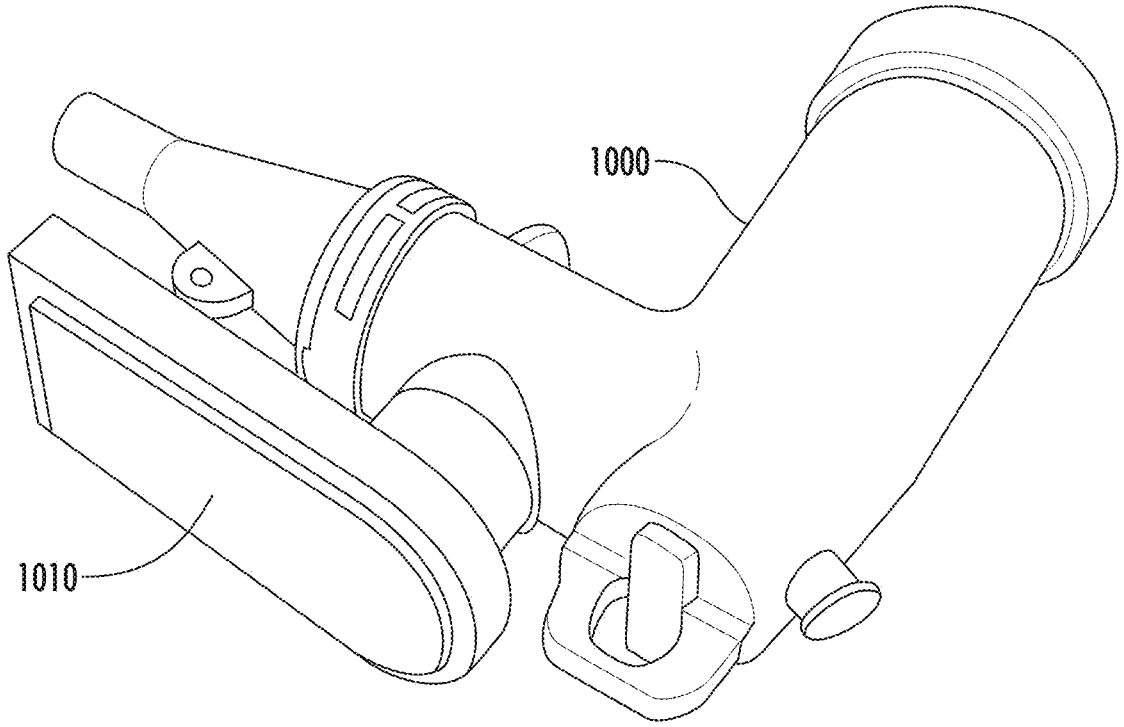
FIG. 12 depicts a perspective view of the sensor of FIGS. 10 and 11 coupled to a load break connector according to example embodiments of the present disclosure.

FIG. 12 depicts a housing 1010 configured to accommodate the sensor 900 of FIGS. 9-11. As shown, the housing 1010 can be coupled to the load-break connector 1000. The housing 1010 can protect the sensor 900 from harsh environmental conditions (e.g., humidity). It should be appreciated that the housing 1010 can be comprised of any suitable material. For instance, the housing 1010 can be comprised of plastic.

Figure 13:
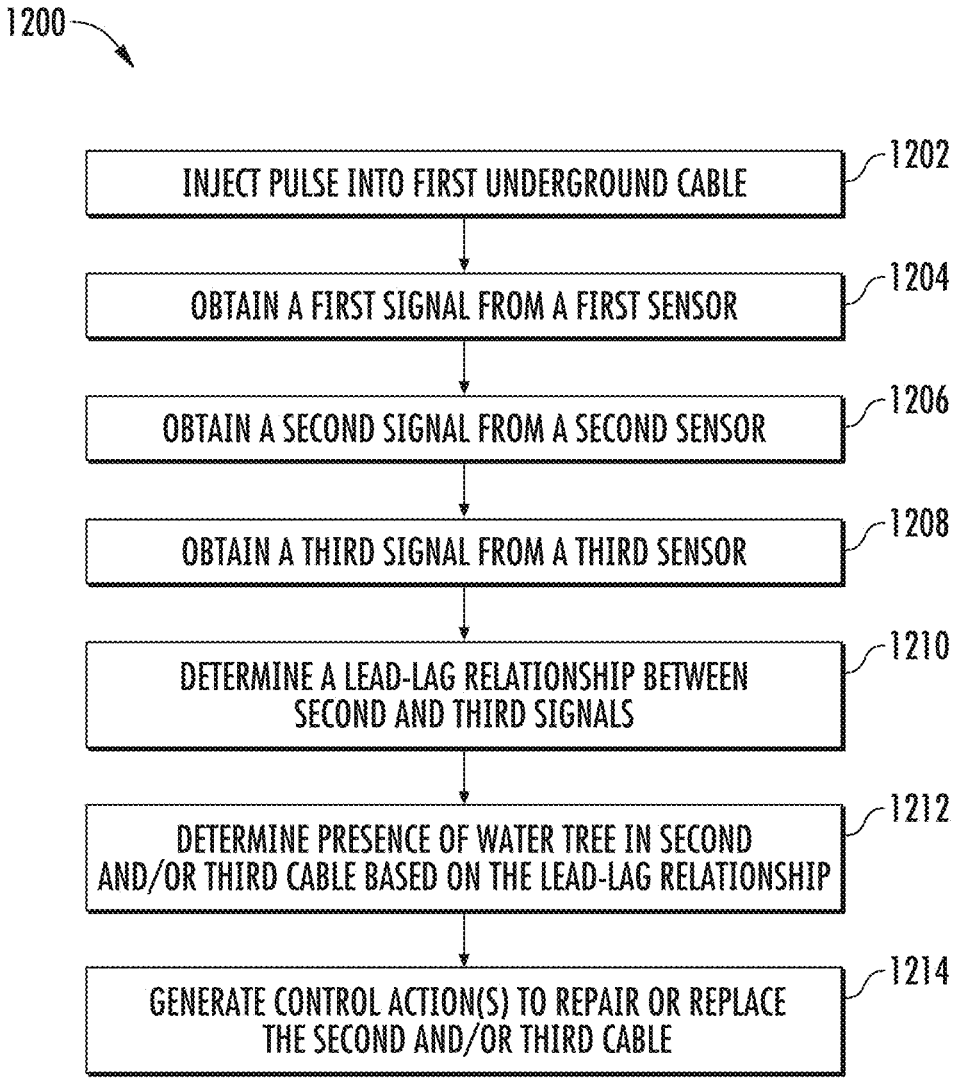
FIG. 13 provides a flow diagram of an example method for detecting water trees in branches underground cables according to example embodiments of the present disclosure.

FIG. 13 depicts a flow diagram of an example method for detecting water trees in branching underground cables comprising a first underground cable that branches into a second underground cable and a third underground cable according to example embodiments of the present disclosure. The method 1200 may be implemented using, for instance, the system discussed above with reference to FIG. 7. FIG. 13 depicts steps performed in a particular order for purposes of illustration and discussion. Those of ordinary skill in the art, using the disclosures provided herein, will understand that various steps of the method 1200 may be adapted, modified, rearranged, performed simultaneously or modified in various ways without deviating from the scope of the present disclosure.

At (1202), the method 1200 comprises injecting a pulse into the first underground cable. In example embodiments, a frequency of the pulse can be different than a frequency associated with alternating current power that is present on the first underground cable. More specifically, the frequency of the pulse can be greater than the frequency associated with the alternating current power.

At (1204), the method 1200 comprises obtaining, by the processor(s), a first signal associated with a first sensor configured to detect signals traveling along the first underground cable.

At (1206), the method 1200 comprises obtaining, by the processor(s), a second signal associated with a second signal configured to detect signals traveling along the second underground cable.

At (1208), the method 1200 comprises obtaining, by the processor(s), a third signal associated with a third sensor configured to detect signals traveling along the third underground cable.

At (1210), the method 1200 comprises determining, by the processor(s), a lead-lag relationship between the second signal and the third signal. In example embodiments, the processor(s) can compare the second and third signals against one another during discrete periods of time. For instance, the processor(s) can compare the second and third signals during a period of time in which both the second and third signal comprise a reflected pulse. If the reflected pulse of the second signal occurs before the reflected pulse of the third signal, the processor(s) can determine the second signal leads the third signal. Additionally, the processor(s) can determine the reflected pulse originated in the second underground cable and subsequently traveled into the third underground cable.

At (1212), the method 1200 comprises determining, by the processor(s), presence of a water tree within at least one of the second underground cable and the third underground cable based on the lead-lag relationship. As an example, if the second signal leads the third signal and both comprise a reflected pulse indicative of a water tree, the water tree resides in the second underground cable. More specifically, the reflected pulse can be inverted relative to the pulse injected into the first underground cable, because the impedance of the water tree is different than the impedance of the underground cables.

At (1214), the method 1200 comprises generating, by the processor(s), one or more control actions associated with repairing or replacing at least one of the second underground cable and the third underground cable. In example embodiments, the one or more control actions can comprise generating a notification (e.g., short message service (SMS) text, electronic mail, etc.) to a remote device, such as a control station at a powerplant. In this manner, the notification can inform appropriate parties of the detected water tree and allow them to take appropriate action.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for detecting water trees in branching underground electrical cables, the system comprising:

a pulse generator configured to inject a pulse into a first underground cable that branches into a second underground cable and a third underground cable;

a first sensor associated with the first underground cable;

a second sensor associated with the second underground cable;

a third sensor associated with the third underground cable; and a control device configured to perform operations, the operations comprising:

obtaining a first signal associated with the first sensor;

obtaining a second signal associated with the second sensor;

obtaining a third signal associated with the third sensor;

determining a lead-lag relationship between the second signal and the third signal;

determining presence of a water tree within at least one of the second underground cable and the third underground cable based on the lead-lag relationship; and responsive to determining presence of the water tree, generating one or more control actions associated with repairing or replacing at least one of the second underground cable and the third underground cable.

2. The system of claim 1, wherein the pulse generator injects the pulse into the first underground cable via a capacitive test point of a load-break connector that is coupled to the first underground cable.

3. The system of claim 1, wherein the second signal comprises:

a first reflected pulse occurring after the pulse enters the second underground cable; and a second reflected pulse occurring after the first reflected pulse.

4. The system of claim 3, wherein the first reflected pulse is inverted relative to the second reflected pulse.

5. The system of claim 3, wherein the third signal comprises:

a first reflected pulse occurring after the pulse enters the third underground cable; and a second reflected pulse occurring after the first reflected pulse of the third signal.

6. The system of claim 5, wherein:

the first reflected pulse of the second signal leads the first reflected pulse of the third signal; and the lead-lag relationship indicates the second signal leads the third signal.

7. The system of claim 6, wherein determining presence of the water tree comprises determining a location of the water tree within the second underground cable based, at least in part, on a time difference between the first and second reflected pulses of the second signal.

8. The system of claim 7, wherein generating the one or more control actions comprises generating a notification associated with repairing or replacing the second underground cable.

9. A method for detecting water trees in branching underground electrical cables comprising a first underground cable that branches into a second underground cable and a third underground cable, the method comprising:

injecting, by a pulse generator, a pulse into the first underground cable; obtaining, at one or more processors, a first signal associated with a first sensor configured to detect signals traveling along the first underground cable;

obtaining, at one or more processors, a second signal associated with a second sensor configured to detect signals traveling along the second underground cable;

obtaining, at the processor(s), a third signal from a third sensor configured to detect signals traveling along the third underground cable;

determining, by the processor(s), a lead-lag relationship between the second signal and the third signal;

determining, by the processor(s), presence of a water tree within at least one of the second underground cable and the third underground cable based on the lead-lag relationship; and responsive to determining presence of the water tree, generating, by the processor(s), one or more control actions associated with repairing or replacing at least one of the second underground cable and the third underground cable.

10. The method of claim 9, wherein the second signal comprises:

a first reflected pulse occurring after the pulse enters the second underground cable; and a second reflected pulse occurring after the first reflected pulse.

11. The method of claim 10, wherein the third signal comprises:

a first reflected pulse occurring after the pulse enters the third underground cable; and a second reflected pulse occurring after the first reflected pulse of the third signal.

12. The method of claim 11, wherein:

the first reflected pulse of the second signal occurs before the first reflected pulse of the third signal; and the lead-lag relationship indicates the second signal leads the third signal.

13. The method of claim 12, wherein determining presence of the water tree comprises determining a location of the water tree within the second underground cable based, at least in part, on a time difference between the first and second reflected pulses of the second signal.

14. The method of claim 13, wherein generating the one or more control actions comprises generating a notification associated with repairing or replacing the second underground cable.

* * * * *